US006022279A

United States Patent [19]

Yamagishi et al.

[11] Patent Number: 6,022,279

[45] Date of Patent: Feb. 8, 2000

[54] GOLF BALL

[75] Inventors: Hisashi Yamagishi; Yasushi Ichikawa; Shunichi Kashiwagi; Rinya Takesue; Akira Kawata, all of Saitama, Japan

[73] Assignee: Bridgestone Sports Co., Ltd., Tokyo, Japan

[21] Appl. No.: 08/980,893

[22] Filed: Dec. 1, 1997

[30] Foreign Application Priority Data

Feb. 12, 1996 [JP] Japan ..... 8-321273

[51] Int. Cl.[7] ..... A63B 37/12; A63B 37/14

[52] U.S. Cl. ..... 473/353; 473/200; 473/365; 473/377; 473/378

[58] Field of Search ..... 473/200, 376, 473/385, 353, 378, 365, 377; 40/327

[56] References Cited

U.S. PATENT DOCUMENTS 5,228,697 7/1993 Gulick et al. ..... 473/200
5,506,292 4/1996 Horiuchi et al. ..... 473/385
5,540,438 7/1996 Horiuchi et al. ..... 473/376
5,651,741 7/1997 Masutani et al. ..... 473/200

*Primary Examiner*—George J. Marlo
*Attorney, Agent, or Firm*—Sughrue, Mion, Zinn, Macpeak & Seas, PLLC

[57] ABSTRACT

In a golf ball colored other than white, the color tone thereof as represented in accordance with the CIELAB color system has an L value of not less than 80, an a value of −30 to +30, and a b value of −30 to +30. The golf ball is preferably colored blue, green, pink, yellow, or orange. Usually, the cover layer of the golf ball is colored in order to color the golf ball. The golf ball does not cause a golfer to feel mental or visual incompatibility while addressing the ball, looks white as viewed from a distance, but looks other than white as viewed at close range to thereby distinguish itself from other balls. Also, the golf ball has improved fashionable features as compared with conventional color balls.

7 Claims, 1 Drawing Sheet

GOLF BALL

BACKGROUND OF THE INVENTION

1. Field of the Invention

The present invention relates to a golf ball colored other than white.

2. Description of the Related Art

Most golf balls are colored white, while golf balls colored other than white (color balls) are barely used, and only in the winter season. Since color balls stand out on withered whitish lawn in winter to thereby provide good visibility, color balls are intended for use in winter. Accordingly, color balls are colored quite deep.

At present, color balls are hardly accepted by golfers and appear on the market merely in winter. Since present color balls are colored quite deep as mentioned above, golfers feel mental or visual incompatibility while addressing the ball. This is the reason for the unpopularity of color balls. Also, since color balls are colored too deep in contrast with white of regular golf balls, color balls are not accepted by the market. However, color balls are very advantageous in terms of the following criteria and are therefore desired to solve the above drawbacks.

(1) In playing golf, each player must distinguish his or her ball from those of others. If a player hits a wrong ball, he or she will be penalized. A player identifies his or her ball by means of a mark or number marked on the ball. When a player uses a white golf ball as do other players, he or she needs to closely look at a mark or number marked on a ball for identification. Particularly, when a ball is caught in rough or a like place, the ball is hard to identify, since it is difficult to see. By contrast, if a golf ball colored different from other player's is used, the ball is very easily distinguished from other balls.

(2) Recently, as golfers increase in number, people of various generations tend to play golf, and female golfers are also increasing in number. Accordingly, there is an increasing demand for incorporating fashionable features into golf balls and other golf goods. Golf balls colored other than white will meet such demand.

SUMMARY OF THE INVENTION

The present invention has been accomplished in view of the foregoing fact, and an object of the present invention is to provide a golf ball colored other than white which does not cause a golfer to feel mental or visual incompatibility while addressing the ball, which looks white as viewed from a distance, but looks other than white as viewed at close range to thereby distinguish itself from other balls, and which has improved fashionable features as compared with conventional color balls.

To achieve the above object, the present invention provides a golf ball colored other than white, wherein a color tone thereof as represented in accordance with the CIELAB color system has an L value of not less than 80, an a value of −30 to +30, and a b value of −30 to +30.

The method of representing a color tone in accordance with the CIELAB color system is specified in JIS-Z-8729. In the method, the L (lightness), a, and b values are expressed as below through use of tristimulus values X, Y, and Z specified in JIS-Z-8701 or JIS-Z-8728.

$$L=116(Y/Y_n)^{1/3}-16$$

$$a=500[(X/X_n)^{1/3}-(Y/Y_n)^{1/3}]$$

$$b=200[(Y/Y_n)^{1/3}-(Z/Z_n)^{1/3}]$$

where $X_n$, $Y_n$, $Z_n$: Three stimulus values in the XYZ system of a perfect reflecting diffuser A golf ball of the present invention has an L value of not less than 80, an a value of −30 to +30, and a b value of −30 to +30; that is, the L, a, and b values are determined such that they provide a synergistic effect, whereby a golfer does not feel mental or visual incompatibility while addressing the ball, and the golf ball looks white as viewed from a distance, but looks other than white as viewed at close range, and also has improved fashionable features.

By contrast, as the L value becomes less than 80, a color loses lightness to become a rather dark tone. As the a value becomes greater than +30, a color becomes too reddish; as the a value becomes less than −30, a color becomes too greenish. As the b value becomes greater than +30, a color becomes too yellowish; as the b value becomes less than −30, a color becomes too purplish. Accordingly, if any of the L, a, and b values falls outside the corresponding range mentioned above, the object of the present invention will not be achieved.

In the present invention, the L value is more preferably not less than 85, particularly preferably not less than 88; the a value is more preferably from −28 to +28, particularly preferably from −25 to +25; and the b value is more preferably from −28 to +28, particularly preferably from −25 to +25. Also, in the present invention, a golf ball is colored particularly preferably blue, green, pink, yellow, or orange.

BRIEF DESCRIPTION OF THE DRAWING

The sole FIGURE illustrates the preferred embodiments of this invention.

DESCRIPTION OF THE PREFERRED EMBODIMENTS

Figure 1:
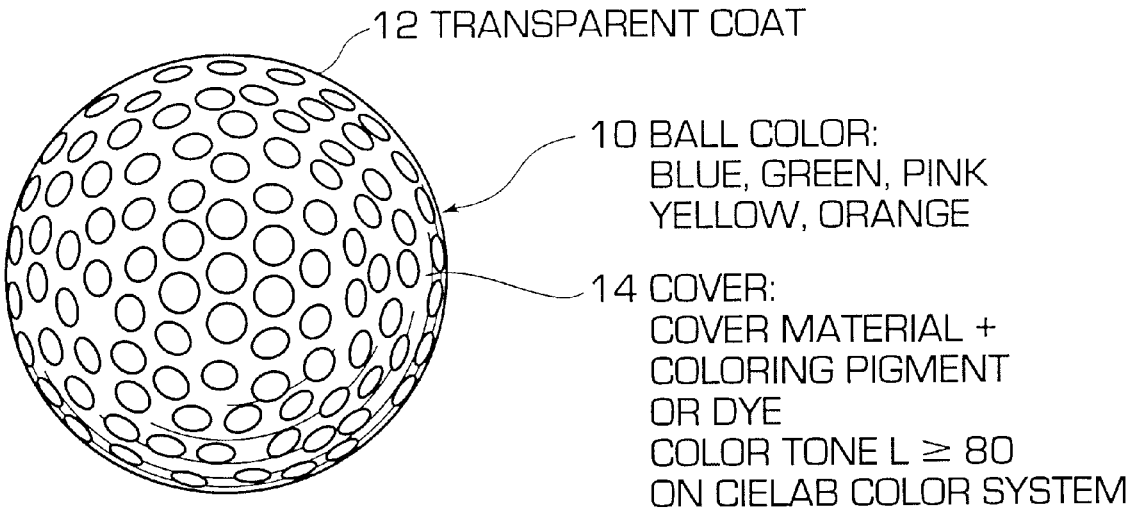

The present invention may be embodied in any of multi-piece solid golf balls such as two-piece golf balls and three-piece golf balls, thread-wound golf balls, one-piece golf balls, and the like. The FIGURE is illustrative of all constructions.

A golf ball 10 may be colored by coloring its cover 14 or outermost coating layer or both so long as its color tone as represented in accordance with the CIELAB color system has the L, a, and b values falling in the aforementioned ranges. Usually, a cover is colored. In the case of coloring a cover 14, the cover is preferably colored through mixture of a cover material (e.g. an ionomer resin, a urethane resin, a polyester resin, or a mixture of a polyurethane resin and a polyester resin) with a coloring agent such as a pigment or a dye. In the case of coloring an outermost coating layer, the coating layer is preferably colored through mixture of a coating material (e.g. a two component system urethane coating material, an aqueous emulsion coating material, or an ultraviolet curing type acrylic coating material) with a coloring agent such as a pigment or a dye. A golf ball of the present invention is not necessarily colored solid, but may be colored in two or more colors.

EXAMPLES

Two-piece golf balls colored as shown in Table 1 were manufactured. In this case, a solid core formed of polybutadiene rubber was covered, by compression molding, with an ionomer resin mixed with a coloring agent. Thereafter, the surface of the cover was coated with a transparent coating material (a two component system urethane coating material) 12. Each of the balls was measured for the L value, the a value, and the b value through use of a spectrophotometer with multiple light sources manufactured by Suga Shikenki Co., Ltd. Also, each ball was examined for sensory incompatibility while a golfer was addressing the ball and for appearance (as viewed from a distance and at close range). The appearance of a ball as viewed from a distance was that as viewed approximately 50 m away from a ball, whereas the appearance of a ball as viewed at close range was that as viewed approximately 5 m away from a ball. The results were shown in Table 1 and 2.

TABLE 1

| | Examples | | | | |
|---|---|---|---|---|---|
| | 1 | 2 | 3 | 4 | 5 |
| Color | Blue | Green | Pink | Yellow | Orange |
| L value | 91.47 | 94.4 | 94.37 | 97.64 | 90.44 |
| A value | −6.63 | −14.98 | 9.78 | −8.73 | 5.67 |
| B value | −12.59 | 11.12 | −3.53 | 21.87 | 19.91 |
| Sensory incompatibility during addressing | A | A | A | A | A |
| Appearance of ball | | | | | |
| As viewed from a distance (approx. 50 m) | 1 | 1 | 1 | 1 | 1 |
| As viewed at close range (approx. 5 m) | 2 | 2 | 2 | 2 | 2 |

TABLE 2

| | Comparative Examples | | | |
|---|---|---|---|---|
| | 1 | 2 | 3 | 4 |
| Color | Pink | Purple | Blue | Yellow |
| L value | 55.91 | 75.8 | 68.53 | 80.21 |
| A value | 92.68 | 13.08 | −3.41 | 10.52 |
| B value | 5.88 | −13.88 | −34.27 | 48.36 |
| Sensory incompatibility during addressing | X | B | B | X |
| Appearance of ball | | | | |
| As viewed from a distance (approx. 50 m) | 3 | 2 | 2 | 3 |
| As viewed at close range (approx. 5 m) | 3 | 3 | 3 | 3 |

Sensory incompatibility during addressing

A: Not felt

B: Somewhat felt

X: Felt

Appearance of ball

1: Looks white

2: Perceived to be colored in a pale color

3: Perceived to be colored in a definite color

As seen from Table 1 and 2, the golf balls of the present invention having an L value of not less than 80, an a value of −30 to +30, and a b value of −30 to +30 do not cause a golfer to feel sensory incompatibility while addressing the balls, and look white as viewed from a distance, but look in a pale color other than white as viewed at close range. By contrast, the golf balls of Comparative Examples wherein at least one of the L, a, and b values falls outside the corresponding range(s) mentioned above cause a golfer to feel sensory incompatibility while addressing the balls, and are perceived to be colored as viewed from a distance and at close range, and particularly, are perceived to be colored in a definite color as viewed at close range.

What is claimed is:

1. A golf ball comprising a cover colored blue, green, pink, yellow, or orange through mixture of a cover material with a coloring pigment or a coloring dye, and the surface of said cover coated with a transparent coating material as a outermost coating layer, wherein a color tone of the golf ball as represented in accordance with the CIELAB color system has an L value of not less than 80, an a value of −30 to +30, and a b value of −30 to 30+.

2. A golf ball according to claim 1, wherein the L value is not less than 85.

3. A golf ball according to claim 1, wherein the L value is not less than 88.

4. A golf ball according to claim 1, wherein the a value is from −28 to +28.

5. A golf ball according to claim 1, wherein the a value is from −25 to +25.

6. A golf ball according to claim 1, wherein the b value is from −28 to +28.

7. A golf ball according to claim 1, wherein the b value is from −25 to +25.

* * * * *